US006767224B2

(12) United States Patent
Wu

(10) Patent No.: US 6,767,224 B2
(45) Date of Patent: Jul. 27, 2004

(54) ELECTRICAL CONNECTOR WITH IMPROVED TERMINAL RETAINING SYSTEM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 3 days.

(21) Appl. No.: 10/215,977

(22) Filed: Aug. 8, 2002

(65) Prior Publication Data

US 2004/0029452 A1 Feb. 12, 2004

(51) Int. Cl.[7] ..... H01R 9/09
(52) U.S. Cl. ..... 439/79; 439/374
(58) Field of Search ..... 439/679, 660, 439/676, 79, 80, 60

(56) References Cited

U.S. PATENT DOCUMENTS 5,658,154 A * 8/1997 Bumsted et al. ..... 439/79
5,688,129 A * 11/1997 Flaherty ..... 439/79
5,779,489 A * 7/1998 Davis et al. ..... 439/79
5,876,222 A * 3/1999 Gardner et al. ..... 439/79
5,879,171 A 3/1999 Wu
5,980,273 A * 11/1999 Yong et al. ..... 439/79
6,036,549 A 3/2000 Waiff
6,077,092 A 6/2000 Chiu et al.
6,080,011 A * 6/2000 Tsao et al. ..... 439/541.5
6,135,790 A * 10/2000 Huang et al. ..... 439/79
6,168,466 B1 * 1/2001 Chiou ..... 439/607
6,350,134 B1 2/2002 Fogg et al.
2003/0134529 A1 * 7/2003 Murr et al. ..... 439/79

* cited by examiner

*Primary Examiner*—Hien Vu
(74) *Attorney, Agent, or Firm*—Wei Te Chung

(57) ABSTRACT

An electrical connector (1) comprises an insulative housing (2) and a plurality of signal and grounding terminals (30, 32) received in the housing and each having an identical structure. The housing defines a main body (20), a tongue (26) extending forwardly from the main body along a mating direction of the connector, a platform (28) extending from the main body opposite to the tongue, and a leading arm (24) extending from the main body in the mating direction. The tongue has first terminal passageways (260) and second terminal passageways (262), wherein front ends of the first terminal passageways are behind front ends of the second terminals passageways. The platform defines first grooves (280) corresponding to the first terminals passageways and second grooves (282) corresponding to the second terminals passageways, wherein the second grooves are deeper than the first grooves. The signal terminals are received in the first passageways and the first grooves, while the grounding terminals are received in the second passageways and the second grooves.

6 Claims, 5 Drawing Sheets

ELECTRICAL CONNECTOR WITH IMPROVED TERMINAL RETAINING SYSTEM

BACKGROUND OF THE INVENTION

1. Field of the Invention

The present invention relates to an electrical connector, and particularly to an electrical connector with an improved terminal retaining system.

2. Description of Related Art

A conventional electrical connector, which has a high-profiled housing and a plurality of terminals consisting of signal terminals and grounding terminals, is used to provide an electrical connection between a mother board and a cable via the connector. In high speed and high density condition, a secure and effective grounding circuit is especially important to maintain signal integrity. Thus, grounding terminals are designed to firstly contact a complement connector when mating. Referring to U.S. Pat. Nos. 6,350,134 and 6,036,549, each of them shows an electrical connector including a housing. The housing defines a plurality of slots to receive a plurality of terminals, which lie alongside one another in the plug-in direction. The terminals generally include electrical signal terminals and ground terminals, wherein the ground terminals are designed to match mating connector prior to the signal terminals.

In order to retain terminals in a housing, referring to U.S. Pat. No. 5,879,171, it disclosed that a high density electrical connector comprises an insulative housing, a number of terminals and a spacer. The housing comprises a body having a number of passageways receiving the terminals therein. The spacer is attached to the housing and comprises a first surface and a second surface. Two rows of terminal positioning holes are disposed in each surface of the spacer. The tail of each terminal is received in corresponding hole of the spacer to properly position in the electrical connector.

However, the conventional connector presents the following problems. The spacer increases the cost of the connector, and assembling difficulty of the connector. Furthermore, the connector needs two different types of terminals for functioning as the signal terminals and grounding terminals. This increases the inventory cost and material and die cost for manufacturing the terminals. Hence, an improved connector is provided to resolve the problems of the prior art.

SUMMARY OF THE INVENTION

Accordingly, an object of the present invention is to provide an electrical connector having a terminal positioning structure which can easily and securely retain terminals of the connector in position.

Another object of the present invention is to provide an electrical connector with grounding terminals engaging a complement connector first to improve electrical performance of the connector.

A further object of the present invention is to provide an electrical connector using one type of terminals functioning as both signal terminals and grounding terminals to reduce cost of the connector.

In order to achieve the objects set forth, an electrical connector of the present invention is used for mating a complementary connector. The electrical connector comprises an insulative housing and a plurality of signal and grounding terminals received in the housing and each having an identical structure. The housing defines a main body, a tongue extending forwardly from the main body along a mating direction of the connector, a platform extending from the main body opposite to the tongue, and a leading arm extending from the main body in the mating direction. The tongue has first terminal passageways and second terminal passageways, wherein front ends of the first terminal passageways are behind front ends of the second terminals passageways. The platform defines first grooves corresponding to the first terminals passageways and second grooves corresponding to the second terminals passageways, wherein the second grooves are deeper than the first grooves. The signal terminals are received in the first passageways and the first grooves, while the grounding terminals are received in the second passageways and the second grooves. Thus, when the electrical connector mates with the complementary connector, the grounding terminals engage with the complementary connector first prior to the signal terminals.

Other objects, advantages and novel features of the invention will become more apparent from the following detailed description when taken in conjunction with the accompanying drawings.

DETAILED DESCRIPTION OF THE INVENTION

Figure 1:
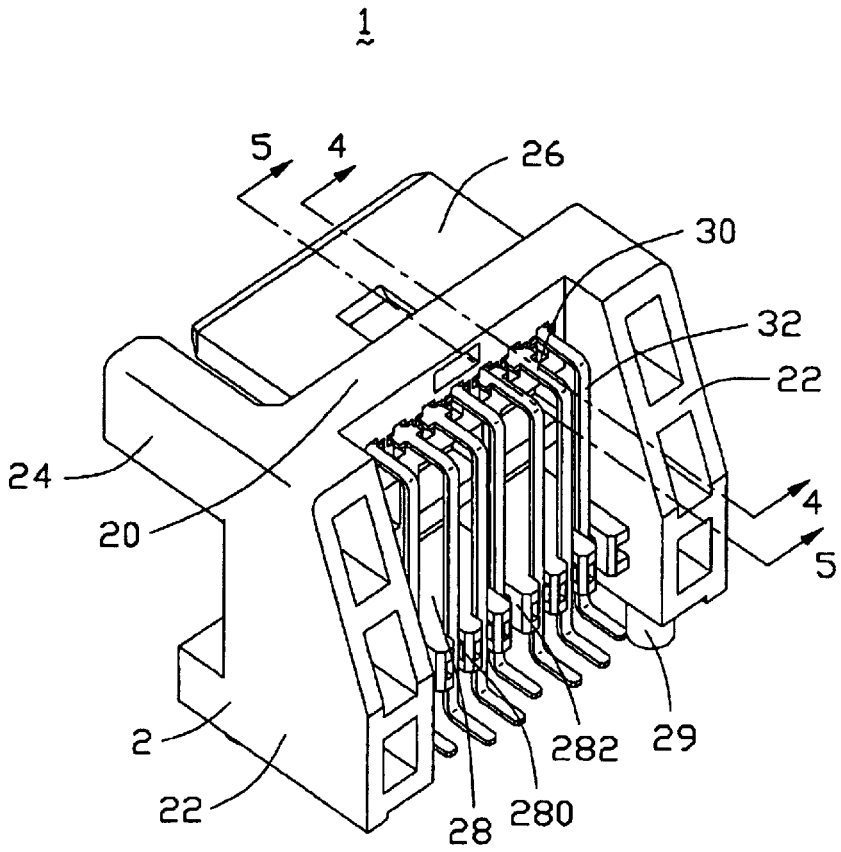
FIG. 1 is a perspective view of an electrical connector in accordance with the present invention.

Reference will now be made to the drawing figures to describe the present invention in detail.

Referring to FIG. 1, an electrical connector 1 of the present invention comprises an insulative housing 2, and a plurality of signal terminals 30 and grounding terminals 32 received in the insulative housing 2. The insulative housing 2 defines a main body 20, two lateral walls 22 extending rearward from opposite sides of the main body 20, a leading arm 24 extending from one side of the main body 20 in a direction opposite the lateral walls 22, and a tongue 26 projecting forward from the main body 20. The tongue 26 and the main body 20 of the housing 2 define a plurality of terminal passageways 260, 262 along mating direction (FIG. 3) for receiving the terminals 30, 32. A pair of posts 29 further extends downward from the two lateral walls 22 for securing the electrical connector 1 on a printed circuit board (not shown). A platform 28 projects from the main body 20 and positioned between and perpendicular to the two lateral walls 22. Further the tongue 26 defines a front surface 264 to face to a complement connector (not shown).

Figure 4:
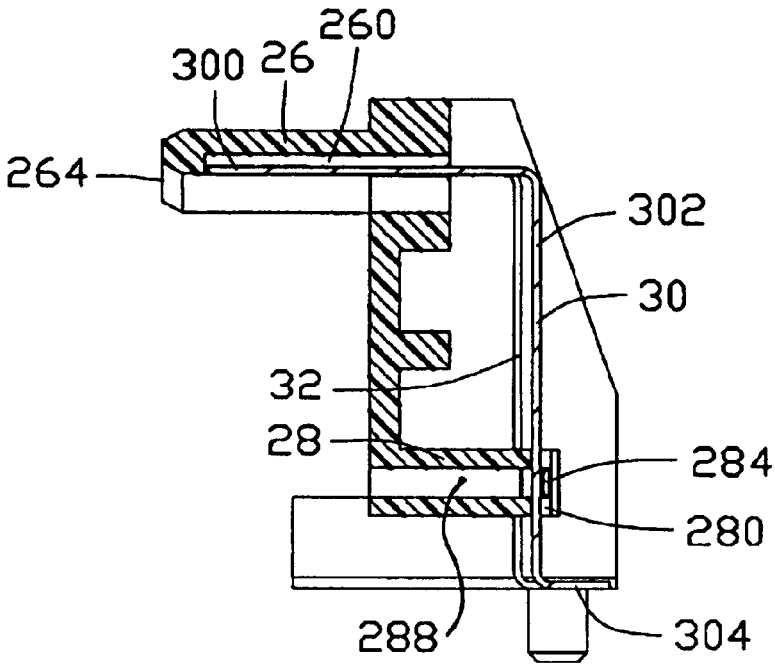
FIG. 4 is a cross-sectional view of the connector taken along line 4—4 of FIG. 1.
Figure 5:
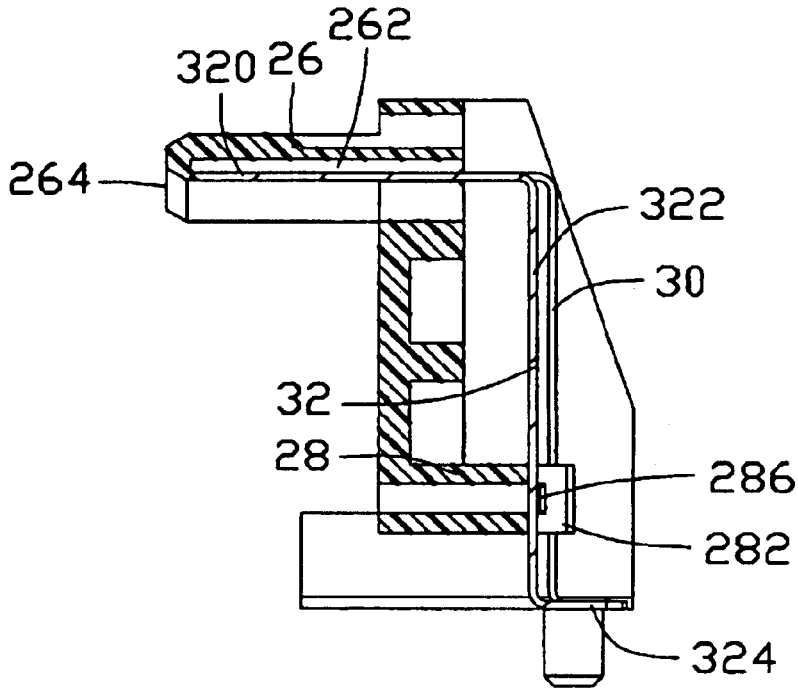
FIG. 5 is a cross-sectional view of the connector taken along line 5—5 of FIG. 1.

Referring to FIGS. 4 and 5, the signal terminals 30 each defines a horizontal engaging portion 300 at a front end thereof, a vertical intermediated portion 302 extending downwardly from the engaging portion 300 and a horizontal soldering portion 304 extending rearwardly from a bottom out of the intermediated portion 302. The grounding terminals 32 have identical structure with the signal terminals 30 for facilitating the manufacturing of the connector 1 and lowering the cost thereof. The grounding terminal 32 defines an engaging portion 320, an intermediated portion 322 and a soldering portion 324.

Figure 2:
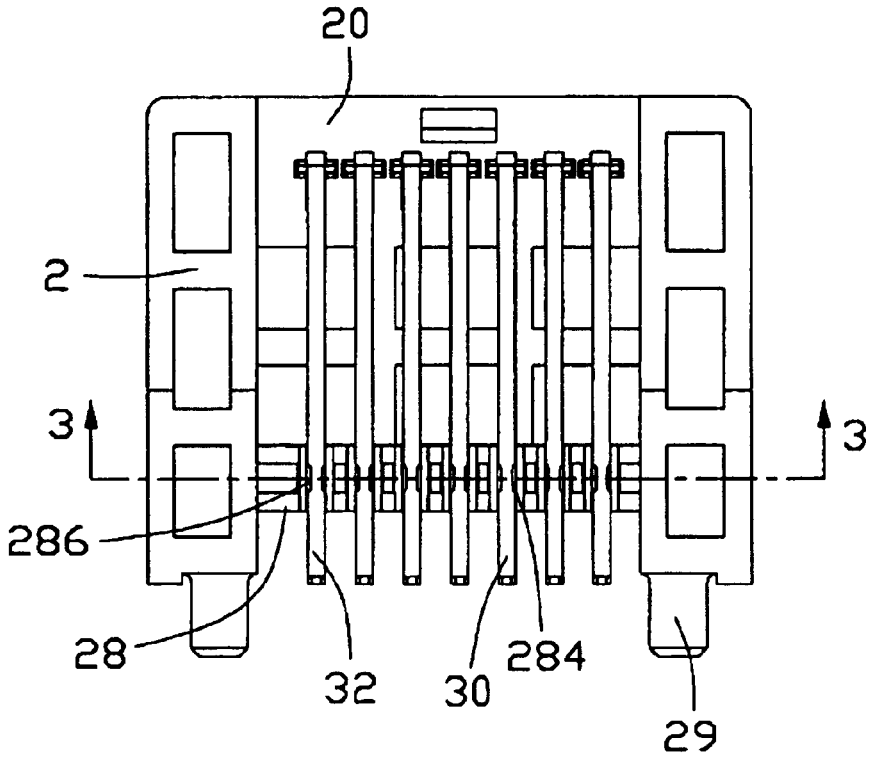
FIG. 2 is a back plan view of the electrical connector of FIG. 1.
Figure 3:
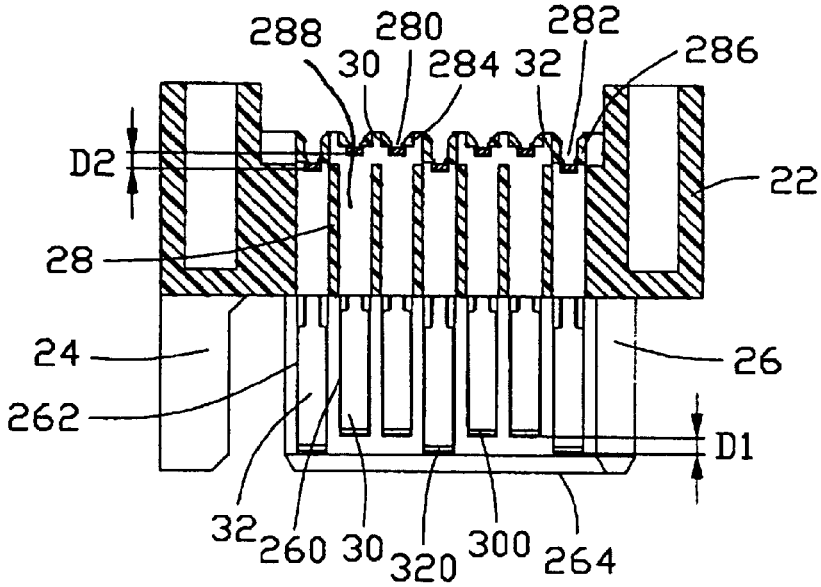
FIG. 3 is a view taken along line 3—3 of FIG. 2.

Referring to FIGS. 2 and 3, the terminal passageways includes first passageways 260 for receiving the signal terminals 30 and second passageways 262 for receiving the grounding terminals 32. Front ends of the first passageways 260 are positioned behind front end of the second passageways 262 thereby defining a difference D1 therebetween.

The platform 28 defines a plurality of first grooves 280 and second grooves 282 for receiving the intermediated portions 302, 322 of the signal terminals 30 and the grounding terminals 32, respectively, wherein these grooves 280, 282 are vertically to extended. The first grooves 280 are shallower than the second grooves 282, whereby a difference D2 is defined between the depths of the grooves 280, 282. The platform 28 forms a pair of first barbs 284 respectively extending into two sides of each of the first grooves 280, and a pair of second barbs 286 respectively extending into two sides of each of the second grooves 282. Each of the first and second barbs 284, 286 has an inclined plane for leading the intermediated portions 302, 322 of the terminals 30, 32 into the grooves 280, 282. In this embodiment, the difference D1 is equal to the difference D2, due to using identical terminal as both signal terminals and grounding terminals. The platform 28 functions as the spacer for alignment of the tails of the terminals wherein the platform defines a cavity 288 therein to increase the resiliency thereof so that the intermediated portions 302, 322 may pass the corresponding barbs 284, 286 in a resilient manner for avoiding wearing or permanent deformation of either the intermediated portions 302, 322 or the barbs 284, 286.

Referring to FIGS. 4 and 5 again, in assembling, the engaging portions 300 of the signal terminals 30 are inserted into the first terminal passageways 260 with the front ends of the engaging portions 300 abutting against the front ends of the first terminals passageways 260 and the intermediated portions 302 fitted in the first grooves 280 and secured by the first barbs 284. The engaging portions 320 of the grounding terminals 32 are inserted into the second terminals passageways 262 with the front ends of the engaging portions 320 abutting against the front ends of the second terminals passageways 262 and the intermediated portions 322 fitted in the second grooves 282 and secured by the second barbs 286. Due to the provision of the differences D1 and D2, the engaging portions 320 of the grounding terminals 32 are located in front of the engaging portions 300 of the signal terminals 30 though the grounding terminals 32 have the identical structure with the signal terminals 30. Thus, the grounding terminals 32 are first engaged with the complementary connector prior to the signal terminals 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating a complementary connector, comprising:

a housing defining a main body, a tongue extending forwardly from the main body along a mating direction, a platform extending from the main body opposite to the tongue, and a leading arm extending from the main body in the mating direction of the connector, the tongue having first terminal passageways and second terminal passageways, wherein front ends of the first terminal passageways being in rear of front ends of the second terminals passageways, and the platform having first grooves corresponding to the first terminals passageways and second grooves corresponding to the second terminals passageways, the second grooves being deeper than the first grooves; and a plurality of signal and grounding terminals each having an identical structure, the signal terminals being received in the first passageways and the first grooves and the grounding terminals being received in the second passageways and the second grooves, whereby when the electrical connector mates with the complementary connector, the grounding terminals engage with the complementary connector first prior to the signal terminals;

wherein the platform forms a pair of barbs extending into two sides of each of the grooves, the barbs engaging with a corresponding terminal and each having an inclined plane; and wherein both the tongue and the platform have a rectangular shape, the terminal passageways being horizontally defined in the tongue and the grooves being vertically defined in the platform.

2. The electrical connector as described in claim 1, wherein the housing has downwardly extending posts for mounting into a printed circuit board.

3. An electrical connector for mating a complementary connector, comprising:

an insulative housing defining a main body, a tongue with a front surface and a parallel platform with a rear surface respectively extending from the main body in opposite directions, the tongue defining a plurality of passageways along a mating direction of the connector, the platform defining a plurality of grooves;

a plurality of first terminals each having an engaging portion received in a corresponding passageway, an intermediated portion extending through a corresponding groove and a soldering portion for soldering to a circuit board;

a plurality of second terminals each having an engaging portion, an intermediated portion and a soldering portion for soldering to a circuit board, the second terminals being identical to the first terminals; and the engaging portions of the second terminals being disposed in corresponding passageways and being located closer to the front surface of the tongue than the engaging portions of the first terminals, and the intermediated portions of the first terminals extending through corresponding grooves and being located closer to the rear surface of the platform than the intermediated portions of the second terminals.

4. The electrical connector as described in claim 3, further comprising a leading arm extending from the main body for leading an insertion of the complement connector.

5. The electrical connector as described in claim 4, further comprising a pair of sidewalls projecting from opposed sides of the main body and wherein the platform forms a pair of barbs extending into opposite sides of each of the grooves; and wherein the tongue and the platform are located in different levels.

6. An electrically connector comprising:

an insulative housing defining a main body with a tongue extending forwardly therefrom;

a platform integrally extending rearwardly from a rear face of the main body;

a plurality of grooves extending in a rear portion of the platform in a front-to-back direction and therethrough in a vertical direction;

a pair of barbs formed on the platform by each of said grooves; and a plurality of terminals disposed in the housing, each of said terminals including a horizontal portion extending forwardly into the tongue, and a vertical portion extending downwardly through the corresponding grooves, respectively, and engaging with the corresponding pair of barbs; wherein said platform is hollow so as to allow the vertical portion to enter the corresponding groove in a back-to-front direction by passing the corresponding pair of barbs the corresponding pair of barbs in an elastic, low interferential manner;

wherein said barbs are dimensioned smaller than the platform in the vertical direction; and wherein the tongue and the platform are located in different levels.

* * * * *